US005836276A

United States Patent [19]

Iwasaki et al.

[11] Patent Number: 5,836,276

[45] Date of Patent: Nov. 17, 1998

[54] ROTATIONAL PHASE ADJUSTING APPARATUS HAVING FLUID RESERVOIR

[75] Inventors: Kazutoshi Iwasaki, Nagoya; Michio Adachi, Obu; Masayasu Ushida, Okazaki; Yoshio Matsumoto, Inabe-gun, all of Japan

[73] Assignee: Denso Corporation, Kariya, Japan

[21] Appl. No.: 907,483

[22] Filed: Aug. 8, 1997

[30] Foreign Application Priority Data

Aug. 9, 1996 [JP] Japan ..... 8-211431

[51] Int. Cl.[6] ..... F01L 1/344

[52] U.S. Cl. ..... 123/90.17; 123/90.31; 123/90.34; 74/568 R; 464/2

[58] Field of Search ..... 123/90.15, 90.17, 123/90.31, 90.33, 90.34; 74/568 R; 464/1, 2, 160

[56] References Cited

U.S. PATENT DOCUMENTS 5,107,804 4/1992 Becker et al. ..... 123/90.17

5,666,914 9/1997 Ushida et al. ..... 123/90.17

FOREIGN PATENT DOCUMENTS

U-2-50105 4/1990 Japan .

*Primary Examiner*—Weilun Lo

*Attorney, Agent, or Firm*—Nixon & Vanderhye P.C.

[57] ABSTRACT

In a vane-type rotational phase adjusting apparatus used for adjusting opening/closing timings of an intake valve or an exhaust valve of an engine, a housing unit driven by a driving shaft has a fan-shaped accommodating chamber between adjacent two of a plurality of shoes arranged circumferentially. A vane unit for driving a driven shaft is disposed in the housing unit with its vanes being disposed in the corresponding one of the accommodating chamber so that the rotational phase of the driven shaft is adjusted by the pressure of fluid in the accommodating chamber. Recesses are formed as fluid reservoirs in a cross-sectionally half circle shape on the circumferential end walls of the shoes to hold the operating fluid therein when the housing unit and the vane unit are at rest because of engine stop.

13 Claims, 3 Drawing Sheets

ROTATIONAL PHASE ADJUSTING APPARATUS HAVING FLUID RESERVOIR

CROSS REFERENCE TO RELATED APPLICATION

This application is related to and incorporates herein by reference Japanese Patent Application No. 8-211431 filed on Aug. 9, 1996.

BACKGROUND OF THE INVENTION

1. Field of the Invention

The present invention relates to a rotational phase adjusting apparatus used for, for example, valve timing adjustment which adjusts opening/closing timings (valve timing) of intake valves and exhaust valves of an internal combustion engine (engine) in accordance with engine operating conditions.

2. Related Art

In a conventional valve timing adjusting apparatus for adjusting valve timings of intake valves and exhaust valves of an engine, a driving force is transmitted from a crankshaft as a driving shaft of the engine to a camshaft as a driven shaft through a driving force transmitting mechanism. As one driving force transmitting mechanism, a vane-type is known by JP-U 2-50105 and JP-A 5-195726.

The vane-type has, within a housing rotatable in synchronization with the crankshaft, vanes rotatable with the camshaft. The rotational phase difference of the camshaft against the crankshaft is controlled by relatively turning the housing and the vanes by fluid pressure, so that the valve timings of the intake valves and the exhaust valves are adjusted in accordance with operating conditions of the engine.

This conventional rotational phase adjusting apparatus used for the valve timing adjustment, however, has a rather low operation reliability arising from the shape of vane accommodating chambers in the housing.

In the conventional vane-type adjusting apparatus, when the accommodating chamber for the vane is located vertically upside at the time of an engine stop, the fluid in the accommodating chamber is likely to leak downwardly through sliding clearances particularly in the case where the engine is kept at rest for a long period of time. Because the operating fluid used for the fluid pressure control works as a lubricant as well, the leakage of the operating fluid from the accommodating chamber will increase friction of the sliding parts of the housing and the vane during the period from a restarting of the engine to a resupply of the operating fluid into various fluid pressure chambers.

The housing and the vanes may be made by a hard material or the sliding surfaces may be hardened to reduce the friction at the sliding part. However, hard materials are not suitable for machining and have larger specific gravities resulting in the increase in the entire weight of the apparatus. Further, hardening the sliding surfaces will result in increase of production processes.

In addition, at the time of machining the inside surface of the fan-shaped chamber for accommodating the vane, angled parts of the housing will impede movement of a machining or cutting tool, or the cutting tool is likely to vibrate excessively due to an excessively increased contact area with a work. The machining defect resulting from the improper operation of the cutting tool will leave pieces of machined material on the inside surface of the housing or cause roughness of the machined surface. This will lead to the low reliability in operation of the apparatus in the end.

In the case where the vane is constructed to extend to both ends of the vane accommodating chamber, a foreign material entering the vane accommodating chamber is likely to be pushed in between the vane and the housing. This will cause an excessive wear or operation failure of the housing and the vane.

SUMMARY OF THE INVENTION

It is therefore an object of the present invention to provide a rotational phase adjusting apparatus which has an improved shape of a vane accommodating chamber for a high reliability.

It is another object of the present invention to provide a rotational phase adjusting apparatus which reduces wear of sliding parts of various movable members in a simplified construction.

It is a further object of the present invention to provide a rotational phase adjusting apparatus which is adapted for an assured machining on an inside surface of a housing for a high reliability.

It is a further object of the present invention to provide a rotational phase adjusting apparatus which is adapted for an assured machining on an inside curved surface of a housing opposing an outer circumferential end of a vane, particularly at its both ends.

It is a still further object of the present invention to provide a rotational phase adjusting apparatus which is adapted for restricting foreign materials from being caught between a housing and a vane.

According to the present invention, a fluid reservoir in a recess shape is provided in at least one of a housing and a vane at a circumferential side wall thereof facing an accommodating chamber so that the fluid reservoir keeps the fluid therein even when the fluid in the accommodating chamber leaks downward as the housing and the vane are kept at rest for a long period of time. When the housing and the vane starts to turn again relatively for operation, the fluid having been held in the fluid reservoir is scattered onto the inside wall of the housing and the outer peripheral wall of the vane or moved along the wall surface. Thus, the fluid in the reservoir works as a lubricant for the sliding parts of the housing and the vane until a operating fluid is supplied into the accommodating chamber again. As a result, the wear of the sliding parts of the housing and the vane is reduced. Further, in the case of using seal members on the sliding parts of the housing and the vane to restrict leakage of the operating fluid from each fluid pressure chambers, wear of the seals can be reduced as well.

Preferably, the fluid reservoir is provided in the housing or the vane so that the fluid is held assuredly in the fluid reservoir even in the case that accommodating chamber or the vane in the housing is held at rest at a vertically upright position at the time of, for instance, engine stop. When the housing and the vane start to turn relatively for operation at the time of, for instance, engine restart, the fluid held in the fluid reservoir works as the lubricant assuredly for the housing and the vane.

Preferably, the housing is made of a relatively soft material having a hardness between HB30 and HB300. This material enables the housing to be machined with ease and to be made in a light weight. Similarly, the vane is made of a relatively soft material as the housing as well for a good machinability and a light weight. The seal is made of a material softer than that of the vane for a better machinability.

Preferably, the housing has a circumferential wall integrally formed with one of its axial end walls so that the fluid leakage through the integrally-formed circumferential wall and the axial side wall.

Preferably, a recess is formed as the fluid reservoir in the wall surface of the housing defining the accommodating chamber and is located at a radially outer position. The recess on the circumferential end wall will not impede the turning operation of the vane. As the recess at the radially outer position is located at the angled corner of the accommodating chamber for the vane, a contact area of a cutting tool or blade with the inside surface of the accommodating chamber is reduced and the excessive vibration of the cutting tool is suppressed when the inside surface of the accommodating chamber is cut in the production process. Even in the case where the foreign material enters the accommodating chamber, the foreign material will not be caught between the housing and the vane because it will be pushed into and held in the fluid reservoir by the turning of the vane in the circumferential direction toward the circumferential end.

Preferably, the recess is formed to extend axially. This will provide a space along the entire axial length for the cutting tool to move at the time of machining the inside surface of the housing. The recess also provides a space for the foreign material to move in the entire axial length as well.

BRIEF DESCRIPTION OF THE DRAWINGS

Other objects, features and advantages of the present invention will become more apparent from the following detailed description when read with reference to the accompanying drawings, in which.

DETAILED DESCRIPTION OF THE PRESENTLY PREFERRED EMBODIMENT

A rotational phase adjusting apparatus according to the present invention will be described with reference to various embodiments which are used for adjusting opening/closing timings of the intake or exhaust valve of an internal combustion engine.

(First Embodiment)

Figure 1:
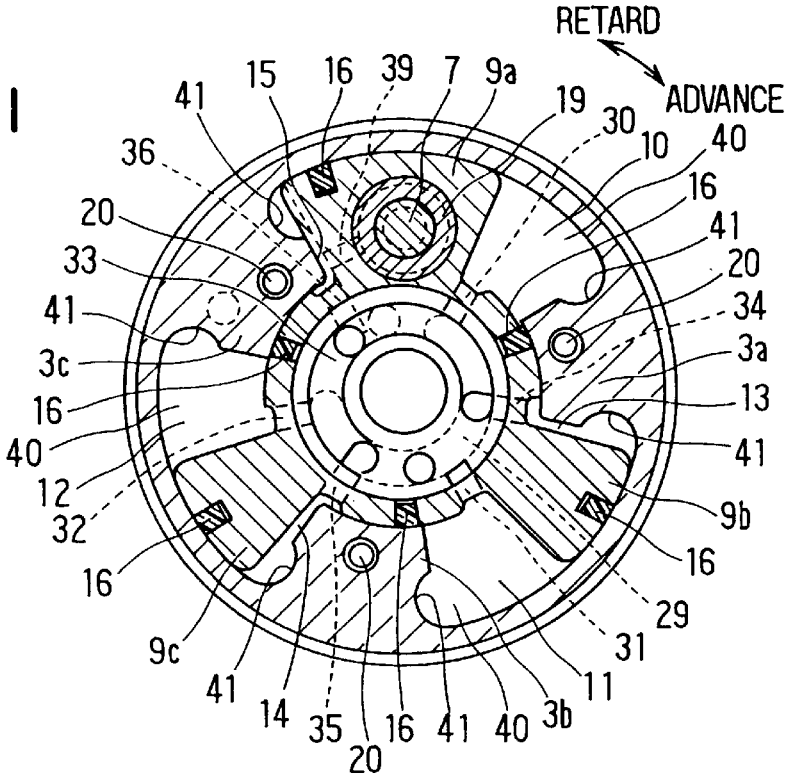
FIG. 1 is a front sectional view of a rotational phase adjusting apparatus according to a first embodiment of the present invention.
Figure 2:
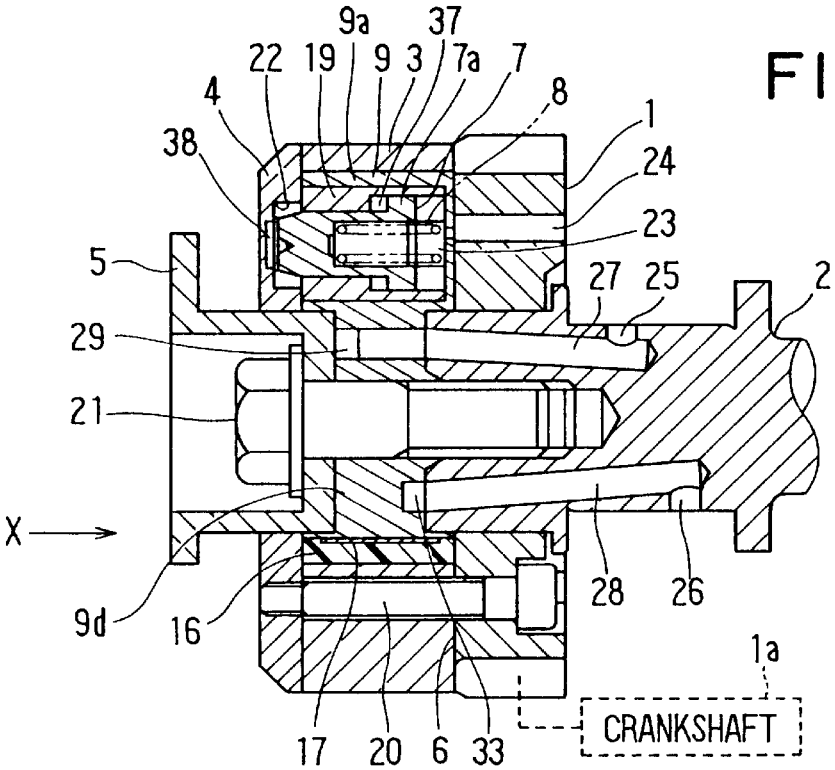
FIG. 2 is a side sectional view of the apparatus according to the first embodiment.

As shown in FIGS. 1 and 2, a timing gear 1 is provided to receive a driving force from a crankshaft 1*a* of an engine (driving shaft) through a gear train (not shown) for synchronous rotation with the crankshaft 1*a*. A camshaft (driven shaft) 2 is provided to receive a driving force from the timing gear to drive intake valves or exhaust valves (not shown) of the engine. The camshaft 2 is held turnably with a rotational phase difference relative to the timing gear 1. The timing gear 1 and the camshaft 2 are rotatable in the clockwise direction when viewed in the direction X in FIG. 2. This clockwise direction corresponds to an advance direction of valve opening/closing timing. A rear plate 6 in a thin ring plate is interposed between the timing gear 1 and a cylindrical shoe housing 3 to restrict fluid leakage between the timing gear 1 and the shoe housing 3. The timing gear 1, shoe housing 3, front plate 4 and rear plate 6 are arranged coaxially and fixed tightly by bolts 20 to constitute a housing unit and rotate together as a drivingside rotation body. The shoe housing 3 forming a circumferential wall of the housing unit has trapezoidal shoes 3*a*, 3*b* and 3*c* arranged circumferentially and spaced apart with a generally equal angular interval. Each of the inside circumferential surfaces of the shoes 3*a*, 3*b* and 3*c* is formed arcuately in section. Fan-shaped chambers 40 are-provided as accommodating chambers for respective vanes 9*a*, 9*b* and 9*c* at three circumferential locations where spacings are provided between adjacent two of the shoes 3*a*, 3*b* and 3*c*.

Each of the shoes 3*a*, 3*b* and 3*c* has recesses 41 as fluid reservoirs on both circumferential side walls thereof which define and face the fan-shaped chambers 40. Each recess 41 is shaped in a semi circle in section in a thickness direction of the shoe housing 3, that is in the circumferential direction, and is located at the radially outer position of the shoe housing 3, that is, at the root position of each shoe 3*a*, 3*b* and 3*c*. The recess 41 extends in the axial direction of the housing 3. The recess may be formed at the same time as molding the shoe housing 3 by casting, die-casting, sintering, extrusion or the like, or may be formed by cutting after the molding.

A vane rotor 9 as a vane unit has the vanes 9*a*, 9*b* and 9*c* arranged cicumferentially with an equal angular interval and accommodated turnably within the corresponding fan-shaped chambers formed circumferentially between the adjacent two of the shoes 3*a*, 3*b* and 3*c*. The vane rotor 9 and a bushing 5 are fixed integrally with the camshaft 2 by a bolt 21 to provide a driven-side rotation body. The bushing 5 fixed integrally with the vane rotor 9 is fitted into the inside wall of the front plate 4 relatively turnably against the front plate 4. A small clearances are provided between the outer circumferential surfaces of the vane rotor 9 and the inner circumferential surfaces of the shoe housing 3 so that the vane rotor 9 and the shoe housing 3 are held relatively turnably. Seals 16 are fitted in the outer circumferential walls of the vanes 9*a*, 9*b* and 9*c* and in the outer circumferential walls of a boss 9*d* of the vane rotor 9 and are biased by respective springs 17 to restrict leakage of the operating fluid between fluid pressure chambers.

Retarding-side fluid pressure chambers 10, 11 and 12 are defined between the shoe 3*a* and the vane 9*a*, between the shoe 3*b* and the vane 9 and between the shoe 3*c* and the vane 9*c*, respectively. Advancing-side fluid pressure chambers 13, 14 and 15 are defined between the shoe 3*a* and the vane 9*b*, between the shoe 3*b* and the vane 9*c* and between the shoe 3*c* and the vane 9*a*, respectively.

According to the above construction, the camshaft 2 and the vane rotor 9 are enabled to turn coaxially and relatively against the shoe housing 3 and the front plate 4.

A guide ring 19 is pressed into the inner wall of the vane 9*a* having an accommodating hole 23 and a stopper piston 7 is inserted into the guide ring 19. The stopper piston 7 is thus accommodated within the vane 9*a* slidably in the axial direction of the camshaft 2 while being biased toward the front plate 4 by a spring 8. The stopper piston 7 receiving the biasing force of the spring 8 is movable into a stopper hole 22 formed in the front plate 4. A communication passage 24 formed in the timing gear 24 is in communication with the accommodating hole 23 at a right side of a flange 7*a* (FIG. 2) and open to the atmosphere so that the stopper piston 7 is not restricted from moving axially.

A fluid pressure chamber 37 at the left side of the flange (FIG. 2) is in communication with the retarding-side fluid pressure chamber 10 through a fluid passage (not shown). With the operating fluid being supplied into the retarding-side fluid pressure chamber 10, the stopper piston 7 moves out from the stopper hole 22 against the biasing force of the spring 8. A fluid pressure chamber 38 formed at the top side of the stopper piston 7 is in communication with the advancing-side fluid pressure chamber 15 through a fluid passage 39 shown in FIG. 1. With the operating fluid being supplied into the advancing-side fluid pressure chamber 10, the stopper piston 7 moves out from the stopper hole 22 against the biasing force of the spring 8.

The positions of the stopper piston 7 and the stopper hole 22 are so determined that the stopper piston 7 is fitted into the stopper hole 22 when the camshaft 2 is at the most retarded position against the crankshaft 1*a*, that is, when the vane rotor 9 is at the most retarded position against the front plate 4. Thus, the stopper piston 7 and the stopper hole 22 provides a lock mechanism.

The boss 9*d* of the vane rotor 9 has a fluid passage 29 at a position where it abuts axial end of the bushing 5 and a fluid passage 33 at a position where it abuts the axial end of the camshaft 2. The fluid passages 29 and 33 are formed arcuately. The fluid passage 29 is in communication with a fluid source or drain (not shown) through fluid passages 25 and 27. Further, the fluid passage 29 is in communication with the retarding-side fluid pressure chambers 10, 11 and 12 through fluid passages 30, 31 and 32 and in communication with the fluid pressure chamber 37 through a fluid passage (not shown).

The fluid passage 33 is in communication with the fluid source or drain (not shown) through fluid passages 26 and 28. Further, the fluid passage 33 is in communication with the advancing-side fluid pressure chambers 13, 14 and 15 through fluid passages 34, 35 and 36 and in communication with the fluid pressure chamber 38 through the advancing-side fluid pressure chamber 15 and a fluid passage 39.

The shoe housing 3, front plate 4 and the rear plate 6, all forming the housing unit, may be made of any materials having a hardness between HB30 and HB300. It is preferred that the material is harder than an aluminum alloy having the hardness of about HB90. In the first embodiment, the housing unit is made of the aluminum alloy. The vane rotor 9 is made of any material having the same hardness as the shoe housing 3 or a lower hardness. In the first embodiment, the vane rotor 9 is made of an aluminum alloy as well. It is preferred that the vane rotor 9 has a hardness higher than HB90. The seals 16 may be made of any materials softer than that of the vane rotor 9. In the first embodiment, it is made of a resin.

The above rotational phase adjusting apparatus operates as follows.

As known in the art, during normal engine operation, the operating fluid supplied to the retarding-side fluid pressure chambers 10, 11, 12 and the advancing-side fluid pressure chamber 13, 14, 15 are used to adjust the valve opening/closing timings and to lubricate the sliding parts of the timing gear 1, shoe housing 3, front plate 4 and the vane rotor 9 as well.

When the engine stops, the operating fluid is not supplied to the retarding-side fluid pressure chambers 10, 11, 12 and the advancing-side fluid pressure chambers 13, 14, 15 so that the vane rotor 9 stops at the most retarded position relative to the shoe housing 3 as shown in FIG. 1. As the operating fluid is not supplied to the fluid pressure chamber 37 and 38 either, the stopper piston 7 fits into the stopper hole 22 by the biasing force of the spring 8.

Figure 3:
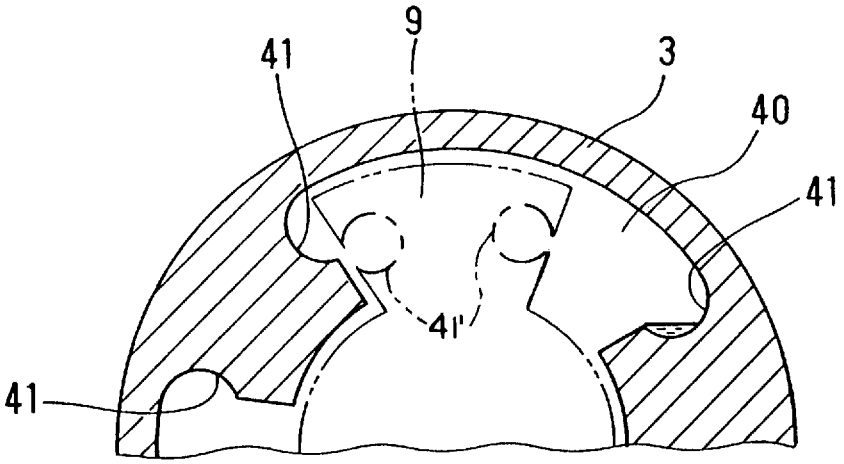
FIG. 3 is a schematic view showing an operation of the apparatus according to the first embodiment.

When the engine is held at rest for a long time, the operating fluid leaks downward in FIG. 3 through sliding clearances from the fan-shaped chamber 40 which is at rest on the vertically upright or upside position. On the contrary, the operating fluid in another fan-shaped chamber 40 at the vertically downside position will remain therein. In the first embodiment, as shown in FIG. 3, the fan-shaped chambers 40 accommodating respective vanes turnably therein are at rest inclinedly so that the uppermost one is not held at the vertically upright position. That is, even in the case that the operating fluid leaks from the uppermost fan-shaped chamber 40, a part of the operating fluid will remain assuredly in at least one of the recesses 41 formed on both circumferential sides of the fan-shaped chamber 40 or alternatively, recessess 41' formed on both sides of vanes 9).

When the engine is restarted after the long rest, it takes some time for the operating fluid to be supplied into the retarding-side fluid pressure chambers 11, 12, 13 and the advancing-side fluid pressure chambers 13, 14, 15. During this period, the operating fluid held in the recess 41 is scattered or moved along wall surfaces by the rotation of the shoe housing 3, thus lubricating the sliding parts of the inner circumferential wall of the shoe housing 3 and the outer circumferential wall of the vane rotor 9 as well as the sliding parts of the axial side walls of the timing gear 1, front plate 4 and vane rotor 9. Thus, even before the operating fluid is supplied to the retarding-side fluid pressure chambers 10, 11, 12 and the advancing-side fluid pressure chambers 13, 14, 15, the wear of the timing gear 1, shoe housing 3, front plate 4, vane rotor 9 and seals 16 all of which are made of soft materials can be reduced.

Even after the engine restarting, the stopper piston 7 is held fitted in the stopper hole 22 until the operating fluid is supplied to the fluid passages and the fluid pressure chambers, so that the camshaft 2 is maintained at the most retarded angular position against the crankshaft 1*a*. Thus, during the period before the operating fluid is supplied to each fluid pressure chamber, the vane rotor 9 is locked to the front plate 4 to prevent the shoe housing 3 and the vane rotor 9 from hitting each other because of changes in the torque of the cam.

As the operating fluid is supplied to the retarding-side fluid pressure chambers 10, 11, 12 and the advancing-side fluid pressure chambers 13, 14, 15, it is also supplied to the fluid pressure chambers 37 and 38. The stopper piston 7, receiving the fluid pressure in the right direction in FIG. 2, moves out from the stopper hole 22 against the biasing force of the spring 8. As the front plate 4 and the vane rotor 9 is thus released from the locked condition, the vane rotor 9 is enabled to turn relatively against the shoe housing 3 in response to the pressure of operating fluid supplied to the retarding-side fluid pressure chambers 10, 11, 12 and the advancing-side fluid pressure chambers 13, 14, 15. Thus, the relative rotational or angular phase of the camshaft 2 against the crankshaft 1*a* is adjusted.

Each recess 41 works as a fluid reservoir during the period of engine rest. It also works as a damper during the period of the phase control for the camshaft 2 against the crankshaft 1*a* in the normal operation of the engine, that is, when the vane rotor 9 is turned relatively from the shoe housing 3 toward the most retarded or advanced position and when the vane rotor 9 is held at the most retarded or advanced position. Therefore, collision impact which the variation in the torque causes between the circumferential side ends of the shoes 3*a*, 3*b* , 3*c* and the vanes 9*a*, 9*b*, 9*c* can be suppressed.

In the above-described first embodiment, as the operating fluid is maintained in the recess 41 formed in the fan-shaped chamber which is at rest at the vertically upperside during the engine stop, the sliding wear caused between the vane unit and the housing unit at the time of engine restarting can be reduced. As a result, the timing gear 1, shoe housing 3, front plate 4, vane rotor 9 and seals 16 can be made of soft materials. Thus, those members can be machined with ease, produced in low cost and in light weight due to light weight of those soft materials.

The radially outer edge of the recess 41 is positioned at the same radial position as the radially outer circumferential wall which defines the fluid pressure chambers 37 and 38, the foreign materials caught by the movement of the vanes are likely to be pushed in to the recesses 41 and will not be caught between the housing and the vanes. Because the recess 41 will work as a play space for the cutting tool when the inside surface of the housing is to be cut, the cutting tool inserted in the axial direction of the housing to cut the inside of the housing is less likely to contact both the circumferential wall surface and the circumferential end wall surface in the housing 3. This will not cause jitter sound and will provide a smooth cut surface. The recess 41 extending axially in the housing 3 provides the play space for the foreign materials and the cutting tool for the entire axial length of the housing 3. The wall surface of the recess 41 is not subjected to cutting and maintains the surface condition provided when the housing is die-casted.

In the first embodiment, the vane rotor 9 is locked to the front plate 4 by the stopper piston 7 as the lock mechanism to restrict the shoe housing 3 and the vane rotor 9 from colliding before the operating fluid is supplied to each fluid pressure chambers at the time of engine starting. It may occur however that, due to poor machining accuracy, the vane rotor 9 jitters causing sliding movement between the component parts even when the stopper piston 7 is fitted in the stopper hole 22. In this instance, the operating fluid in the recess 41 works as a lubricant to suppress the sliding wear between the component parts.

Further, although the shoe housing 3 and the front plate 4 are made separately in the first embodiment, those may be made integrally to simplify assembling work and reducing possibility of leakage of the operating fluid. Though the recess 41 is preferably provided on both circumferential end walls of each shoe defining the circumferential ends of the fan-shaped chambers, it may be provided on only one of the circumferential ends of the shoe. In the case where the housing unit is made of a plurality of component parts, particularly where the shoes are made separately and assembled to the cylindrical wall, the recess may be provided between the plurality of component parts.

Figure 4:
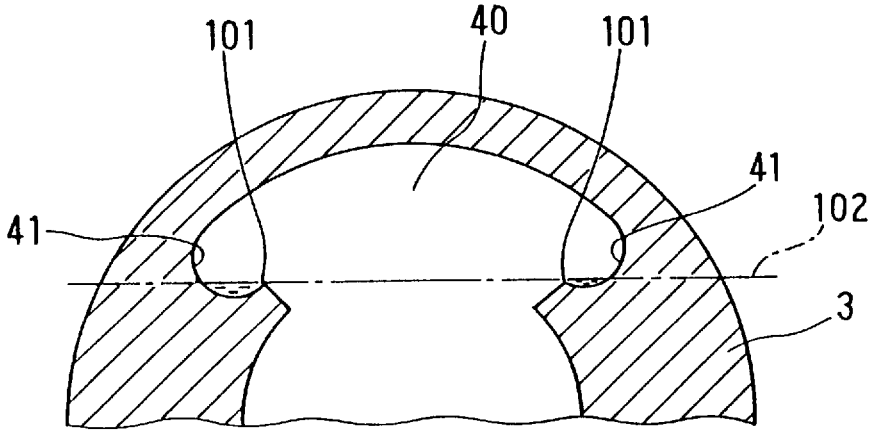
FIG. 4 is a schematic view showing an operation of a modification of the apparatus according to the first embodiment.

As a modification of the first embodiment, as shown in FIG. 4, the recesses 41 are formed preferably to have respective concave parts at a position vertically lower than an imaginary line 102 which crosses radially inside boundary points 101 between the recesses 41 and the circumferential side walls of each shoe. With this configuration of the recess 41, a part of the operating fluid can be held in the recesses 41 without fail even under the situation where the uppermost one of the fan-shaped chambers 40 is held at rest.

(Second Embodiment)

Figure 5:
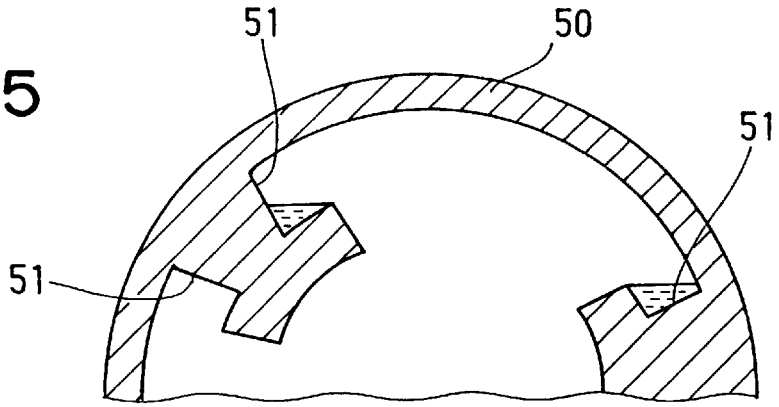
FIG. 5 is a schematic view showing an operation of a rotational phase adjusting apparatus according to a second embodiment of the present invention.

In this embodiment, as shown in FIG. 5, a recess 51 is formed in a rectangular shape in section on each circumferential end wall of a shoe housing 50 at the root or connection part of the shoe with the cylindrical wall of the shoe housing 50. Each recess 51 is concave in the circumferential or thickness direction of the shoe and extends in the axial direction of the housing 50.

According to this configuration, the operating fluid held in the recess 51 will be scattered or moved along the wall surfaces and provides the same operation and advantage as in the first embodiment before the operating fluid is supplied into each fluid pressure chambers at the time of engine restarting after a rest.

(Third Embodiment)

Figure 6:
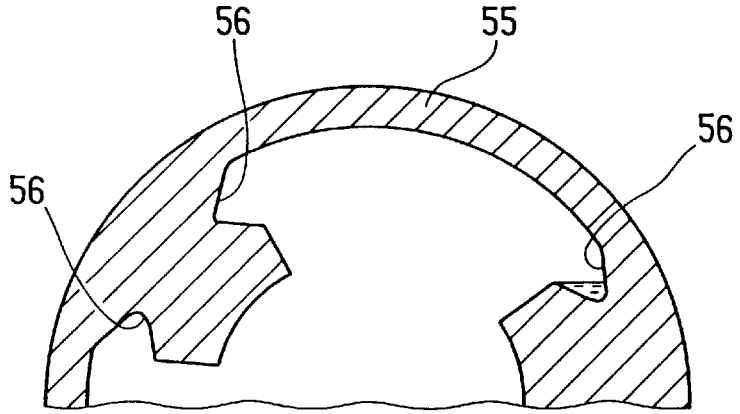
FIG. 6 is a schematic view showing an operation of a rotational phase adjusting apparatus according to a third embodiment of the present invention.

In this embodiment, as shown in FIG. 6, a recess 56 is formed in a triangular shape in section on each circumferential end wall of a shoe housing 55 at the root or connection part of the shoe with the cylindrical wall of the shoe housing 55. Each recess 56 is concave in the circumferential or thickness direction of the shoe and extends in the axial direction of the housing 55.

According to this configuration, the operating fluid held in the recess 56 will be scattered or moved along the wall surfaces and provides the same operation and advantage as in the first embodiment before the operating fluid is supplied into each fluid pressure chambers at the time of engine restarting after a rest.

(Fourth Embodiment)

Figure 7:
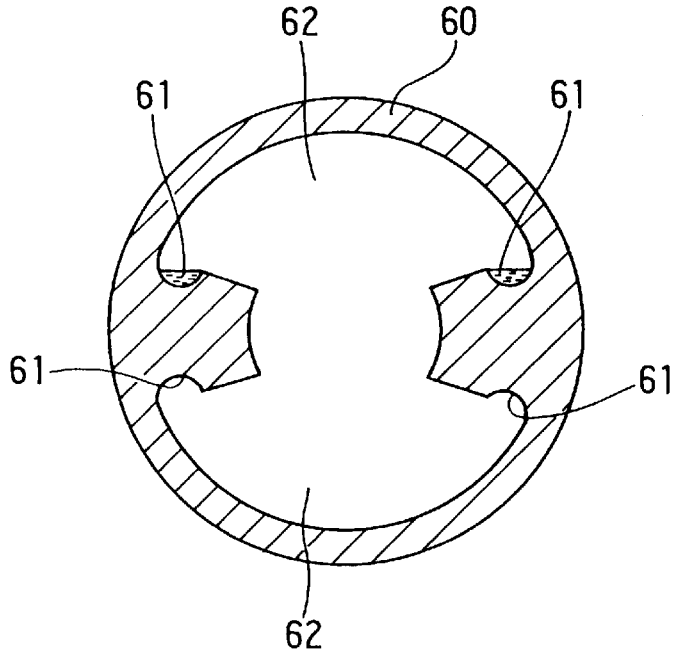
FIG. 7 is a schematic view showing an operation of a rotational phase adjusting apparatus according to a fourth embodiment of the present invention.

In this embodiment, as shown in FIG. 7, a shoe housing 60 has only two fan-shaped chambers 62 so that the relative phase control for the camshaft 2 against the crankshaft 1*a* is attained by two vanes (not shown). On each circumferential end wall of the shoe, a recess 61 in a semicircular shape in section is provided at the connection part with the shoe housing 60.

According to this configuration, the operating fluid held in the recess 61 will be scattered or moved along the wall surfaces and provides the same operation and advantage as in the first embodiment before the operating fluid is supplied into each fluid pressure chambers at the time of engine restarting after a rest.

It is to be noted that, although the recesses as the fluid reservoirs are provided at the radially outermost position of the circumferential end walls of the shoe, that is, at a position where the shoe extends radially inward, each recess may be provided at the more radially inside position on the circumferential end walls of the shoe. Alternatively to or in addition to the recesses on the circumferential end walls of the shoe, recesses may be provided on the circumferential end walls of the vane rotor.

The housing unit and the vane unit may be made of an aluminum or oil-resisting resin, such as PPS (polyphenyl sulfide), PI (polyimide) or the like, as long as such materials have the hardness between HB30 and HB300.

The present invention should not be limited to the above disclosed embodiments or modifications, but may be modified further and may be applied to various systems other than the engine valve timing control system.

We claim:

1. A rotational phase adjusting apparatus for adjusting a rotational phase between a driving shaft and a driven shaft, the apparatus comprising:

a housing disposed in a driving force transmitting system which transmits a driving force from the driving shaft to the driven shaft and rotatable with one of the driving shaft and the driven shaft, said housing having therein an accommodating chamber extending in a predetermined circumferential length;

a vane rotatable with e other of the driving shaft and the driven shaft and accommodated in the accommodating chamber relatively rotatable with respect to the housing in response to an operating fluid supplied to the accommodating chamber; and a fluid reservoir provided in a recess on a circumferential end wall of at least one of the housing and the vane, the recess having a configuration to assist in retaining a part of the operating fluid therein when the cylindrical housing and the vane unit are at all possible resting positions during an engine stop.

2. The rotational phase adjusting apparatus according to claim 1, wherein:

the fluid reservoir is provided on the housing.

3. The rotational phase adjusting apparatus according to claim 1, wherein:

the fluid reservoir has a part to be located vertically below an imaginary line crossing a radially inside boundary between the circumferential end wall and the fluid reservoir under a condition where one of the accommodating chamber and the vane is at rest at a vertically upright position.

4. The rotational phase adjusting apparatus according to claim 1, wherein:

the housing is made of a material having a hardness between HB30 and HB300.

5. The rotational phase adjusting apparatus according to claim 4, wherein:

the vane is made of a material having a hardness lower than that of the housing.

6. The rotational phase adjusting apparatus according to claim 5, further comprising:

a seal disposed between the housing and the vane and made of a material having a hardness lower than that of the vane.

7. The rotational phase adjusting apparatus according to claim 1, wherein:

the housing has a pair of axial end walls and a circumferential wall made integrally with one of the axial end walls.

8. A rotational phase adjusting apparatus for adjusting a rotational phase between a driving shaft and a driven shaft, the apparatus comprising:

a housing disposed between the driving shaft and the driven shaft and rotatable with one of the driving shaft and the driven shaft, said housing having therein an accommodating chamber;

a vane rotatable with the other of the driving shaft and the driven shaft and accommodated in the accommodating chamber relatively rotatable with respect to the housing in response to an operating fluid supplied to the accommodating chamber; and a recess provided on a circumferential end wall of the housing defining the accommodating chamber, the recess being located at a radially outermost position of the circumferential end wall.

9. The rotational phase adjusting apparatus according to claim 8, wherein:

the recess is provided to extend in an axial direction of the housing.

10. The rotational phase adjusting apparatus according to claim 8, wherein:

the housing as a plurality of shoes extending radially inward to have the circumferential end wall at both circumferential ends thereof defining the accommodating chamber therebetween; and the recess is provided at each circumferential end wall.

11. The rotational phase adjusting apparatus according to claim 8, wherein:

the recess has a radially outermost part located at a substantially the same radial position of a radially outermost part of the circumferential end wall.

12. The rotational phase adjusting apparatus according to claim 8, wherein:

the circumferential end wall has a non-cut surface.

13. A rotational phase adjusting apparatus for adjusting a rotational phase between a crankshaft and a camshaft of an engine, the apparatus comprising:

a cylindrical housing coupled with the crankshaft for rotation therewith and having a plurality of shoes extending radially inwardly, each of the shoes extending circumferentially between a pair of circumferential end walls thereof to define an accommodating chamber with an adjacent one;

a vane unit having a plurality of vanes coupled with the camshaft for rotation therewith, each of the vanes being disposed in the corresponding one of the accommodating chambers movable in a circumferential direction in response to an operating fluid in the accommodating chamber, each of the vanes having a pair of circumferential end walls; and a plurality of recesses provided on at least one of the circumferential end walls of the vanes and the shoes, the recesses having a configurating to assist in retaining a part of the operating fluid therein when the cylindrical housing and the vane unit are at all possible resting positions during an engine stop.

* * * * *